US009913061B1

(12) United States Patent
Briand

(10) Patent No.: US 9,913,061 B1
(45) Date of Patent: Mar. 6, 2018

(54) METHODS AND SYSTEMS FOR RENDERING BINAURAL AUDIO CONTENT

(71) Applicant: THE DIRECTV GROUP, INC., El Segundo, CA (US)

(72) Inventor: Manuel Briand, Santa Monica, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 0 days.

(21) Appl. No.: 15/250,261

(22) Filed: Aug. 29, 2016

(51) Int. Cl.
*H04S 1/00* (2006.01)
*H04S 7/00* (2006.01)

(52) U.S. Cl.
CPC ..... *H04S 1/007* (2013.01); *H04S 7/306* (2013.01); *H04S 2400/03* (2013.01); *H04S 2400/11* (2013.01); *H04S 2420/01* (2013.01)

(58) Field of Classification Search
CPC ..... H04S 1/007; H04S 7/306; H04S 2400/03; H04S 2400/11; H04S 2400/01
USPC ..... 381/74, 309, 310; 700/94
See application file for complete search history.

(56) References Cited

U.S. PATENT DOCUMENTS 6,311,155 B1 * 10/2001 Vaudrey ..... G11B 20/00992 381/10
7,266,501 B2 * 9/2007 Saunders ..... G09B 5/04 381/10
7,936,887 B2 * 5/2011 Smyth ..... H04S 7/304 381/309
8,081,762 B2 12/2011 Ojala et al.
8,290,167 B2 * 10/2012 Pulkki ..... H04S 3/02 381/119
8,374,365 B2 2/2013 Goodwin et al.
8,908,873 B2 * 12/2014 Herre ..... H04S 3/02 381/17
9,009,057 B2 * 4/2015 Breebaart ..... H04S 3/004 704/500
9,093,063 B2 7/2015 Vilkamo et al.
9,154,877 B2 10/2015 Kim et al.
9,165,558 B2 10/2015 Dressler
9,190,065 B2 11/2015 Sen
9,288,603 B2 3/2016 Sen et al.
(Continued)

FOREIGN PATENT DOCUMENTS

WO 2015134658 9/2015

OTHER PUBLICATIONS

"Binaural Technology for Mobile Applications", 2006.
(Continued)

*Primary Examiner* — David Ton
(74) *Attorney, Agent, or Firm* — Guntin & Gust, PLC; Atanu Das

(57) ABSTRACT

Aspects of the subject disclosure may include, for example, embodiments receiving audio content in a multi-channel sound format over a communication network resulting in multi-channel audio content. Further embodiments can include identifying a compression ratio of the audio content. Additional embodiments can include determining a rendered sound externalization for rendering the audio content according to the compression ratio of the audio content. Also, embodiments can include rendering the audio content in a binaural audio format for headphone playback on an audio device according to the rendered sound externalization. Other embodiments are disclosed.

20 Claims, 7 Drawing Sheets

(56) References Cited

U.S. PATENT DOCUMENTS

| | | | |
|---|---|---|---|
| 9,313,599 | B2 | 4/2016 | Tammi et al. |
| 9,319,819 | B2 | 4/2016 | Lee et al. |
| 2015/0340044 | A1 | 11/2015 | Kim |
| 2016/0005413 | A1 | 1/2016 | Fellers et al. |
| 2016/0133267 | A1 | 5/2016 | Adami et al. |
| 2016/0150339 | A1 | 5/2016 | Choueiri |
| 2016/0157040 | A1 | 6/2016 | Ertel et al. |

OTHER PUBLICATIONS

Algazi, V. R. , "The CIPIC HRTF Database", 2001.
Breebaart, Jeroen et al., "Multi-channel goes mobile: MPEG surround binaural rendering", Audio Engineering Society Conference: 29th International Conference: Audio for Mobile and Handheld Devices., 2006.
Crawford-Emery, Ryan , "The subjective effect of BRIR length perceived headphone sound externalisation and tonal colouration", 2014.
Mehrotra, Sanjeev , "Interpolation of Combined Head and Room Impulse Response for Audio Spatialization", 2011.
Song, Myung-Suk , "Enhancing Loudspeaker-based 3D Audio with Room Modeling", 2010.

* cited by examiner

100

200

300

301

400

500

SHO
510
511
SHS
530
562
ISP
Network
532
VHO 1
VHO 2
VHO 3
VHO 4
VHO 5
VHO 6
512
514
VHS
518
ACCESS NETWORK
517
529
515
519
Satellite dish
receiver 531
508
566
STB 506
G 504
Ctrl 507
ISP Ntwk 532
STB 506
516
Cable TV
533
564
502
508
Remote
Services

METHODS AND SYSTEMS FOR RENDERING BINAURAL AUDIO CONTENT

FIELD OF THE DISCLOSURE

The subject disclosure relates to methods and systems for rendering binaural audio content.

BACKGROUND

Modern mobile technology and communication networks allow for mobile device users to download or stream media content from media content servers to mobile devices. The audio content associated with such media content can be in a multi-channel audio (or sound) format. For example, multi-channel audio formats can be six channel (5.1) surround sound audio format, eight channel (7.1) audio format as well as other multi-channel audio formats. However, many mobile devices do not have the capability of playing back six audio channels, for example, because audio devices have either two built-in speakers or headphones which can reproduce two channels (e.g. "left and right" channels). Network devices or mobile devices can receive audio content in a multi-channel sound format and render the audio content in a binaural audio format to the two-channel audio device. Further, the rendering of the audio content in the binaural audio format can also include an amount of sound externalization to mimic hearing the audio content in the original multi-channel sound format.

BRIEF DESCRIPTION OF THE DRAWINGS

Reference will now be made to the accompanying drawings, which are not necessarily drawn to scale, and wherein.

DETAILED DESCRIPTION

Figure 1:
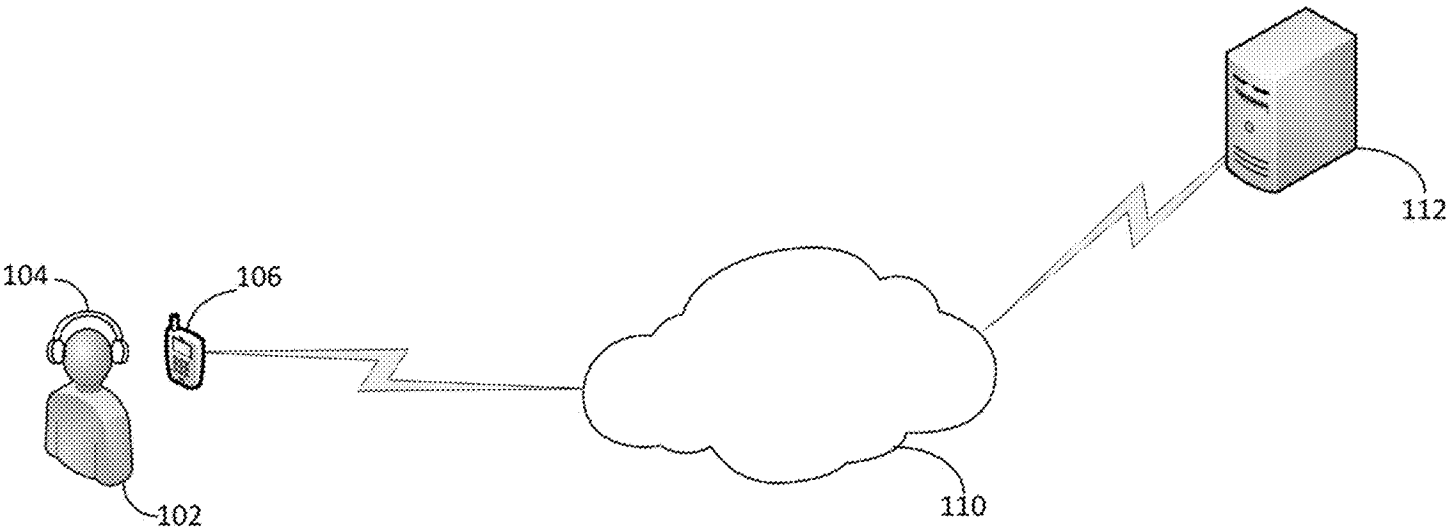
FIGS. 1-2 and FIGS. 3A-3B depict illustrative embodiments of systems for rendering binaural audio content.

The subject disclosure describes, among other things, illustrative embodiments for receiving audio content in a multi-channel sound format over a communication network resulting in multi-channel audio content. Further embodiments can include identifying a compression ratio of the audio content. Additional embodiments can include determining a rendered sound externalization for rendering the audio content according to the compression ratio of the audio content. Also, embodiments can include rendering the audio content in a binaural audio format, such as for headphone playback on an audio device according to the rendered sound externalization. Although disclosed embodiments discuss six channel sound or audio formats being rendered in a two channel binaural audio format, persons of ordinary skill in the art would understand that any multi-channel sound or audio format can be rendered in a two channel binaural audio format. Other embodiments are described in the subject disclosure.

One or more aspects of the subject disclosure include a device comprising a processing system including a processor and a memory that stores executable instructions that, when executed by the processing system, facilitate performance of operations. The operations can include receiving audio content in a multi-channel sound format over a communication network resulting in multi-channel audio content. Further, the operations can include identifying a compression ratio of the audio content. In addition, the operations can include determining a rendered sound externalization for rendering the audio content according to the compression ratio of the audio content. Also, the operations can include rendering the audio content in a binaural audio format for headphone playback on an audio device according to the rendered sound externalization. One or more aspects of the subject disclosure include a machine-readable storage medium, comprising executable instructions that, when executed by a processing system including a processor, facilitate performance of operations. The operations can include configuring an amount of sound externalization according to the default sound externalization. Further embodiments can include receiving audio content in a multi-channel sound format over the communication network resulting in multi-channel audio content and detecting a type of audio content on each channel of the multi-channel audio content. Additional embodiments can include determining a rendered sound externalization for rendering the audio content according to the type of audio content on each channel of the multi-channel audio content, adjusting the amount of sound externalization from the default sound externalization to the rendered sound externalization, and rendering the audio content in a binaural audio format for headphone playback on an audio device according to the rendered sound externalization.

One or more aspects of the subject disclosure include a method. The method can include receiving, by a processing system comprising a processor, audio content in a multi-channel sound format over a communication network resulting in multi-channel audio content. Further, the method can include identifying, by the processing system, a compression ratio of the audio content. In addition, the method can include determining, by the processing system, a rendered sound externalization for rendering the audio content according to the compression ratio of the audio content. Also, the method can include rendering, by the processing system, the audio content in a binaural audio format for headphone playback on an audio device according to the rendered sound externalization. Further, the method can include detecting, by the processing system, a change in the compression ratio of the audio content. In addition, the method can include determining, by the processing system, an updated amount of sound externalization rendering the audio content according to the he change of the compression ratio of the audio content resulting in updated sound externalization. Also, the method can include re-rendering the audio content in a binaural audio format for headphone playback on the audio device according to the updated sound externalization.

FIG. 1 depicts an illustrative embodiment of a system 100 for rendering binaural audio content. In one or more embodiments, a mobile device 106 such as a smartphone can access media content across a communication network 110 from a media content server 112 for a user 102. In some embodiments, the user 102 access the media content through a mobile application running on the mobile device 106. The mobile application allows the user to view the media content on a mobile device display. Further, the user 102 listens to audio content associated with the media content through headphones 104 or some other audio device (e.g. speakers, etc.) for playback. In other embodiments, audio for the media content is provided in a six channel surround sound format compatible with home theater systems that have six speakers placed around a room to provide an enhanced, immersive, 360 degree listening experience when viewing the media content. The channels correspond to the placement of speakers in the room. They include 3 channels corresponding to the 3 speakers placed toward the front of a room with a home theater system, the left channel, the center channel, and the right channel. The channels also include two channels corresponding to speakers placed toward the back of the room, the left surround (or rear) channel, and the right surround (ore rear) channel. The sixth channel corresponds to the subwoofer speaker and carries low frequency effects of the audio content. This channel can be referred to as the low frequency effects channel. In one embodiment, the different channels can be associated with other configurations.

Headphones 104 have two speakers, each fitting onto or into an ear of the user 102, and can be supplied with audio content in a two channel format for an enhanced listening experience by the user 102. Thus, in some embodiments, the mobile device 106 converts the audio content in six channel sound format to audio content in a two channel format. A binaural audio format is the result of converting six channel sound format to a two channel audio format. Further, the binaural audio format provides sound externalization, which provides a perception to the user 102 that the sound is provided outside the headphones thereby mimicking or otherwise simulating surround sound. Sound externalization is provided using digital signal filtering and processing techniques that include filters based on one or more Head Related Transfer Functions (HRTFs) and/or one or more Binaural Room Impulse Response (BRIR) filters.

In or more embodiments, converting audio content from a six channel sound format to a binaural audio format takes into account a capacity of the communication network 110. Further, the audio bit rate or bandwidth takes into account the capacity of communication network 110 to carry audio content. In some embodiments, converting audio content in a six channel sound format to a binaural audio format takes into account the compression ratio of the audio content. Audio compression is the amplification of quiet sounds and the attenuation of loud sounds in the audio content. Hence, the dynamic range between the quiets sounds and the loud sounds of the audio content is narrowed or compressed. The compression ratio indicates input level of the loud sounds (measured in decibels) compared to the attenuated output level of the loud sounds in the audio content. In addition, audio compression ratio is determined by the sampling rate and bit depth (i.e. the number of bits in each sample). Thus, the audio bit rate depends on the compression ratio. For example, a compression ratio may have a sampling rate of 44.1 kHz, bit depth of 16 bits, for two channels resulting in an audio bit rate of 1.4112 Mbps. Thus, when rendering audio content into a binaural audio format, the mobile device 106 can take into account, detect, or otherwise identify the compression ratio and/or audio bit rate.

Audio content with a large compression ratio can contain distortion. Providing more sound externalization to the audio content with large compression when rendering the binaural audio can mitigate or reduce the distortion. In some embodiments, the audio bit rate or compression ratio of the audio content can be in metadata provided with the audio content or otherwise detected, identified or obtained. The mobile device 106 can determine an amount of sound externalization to render with the audio content in binaural audio content according to the audio bit rate and/or compression ratio of the audio content.

In one or more embodiments, the six channel sound format for audio content can carry different types of audio on different channels. For example, the audio content can be associated with media content such as an action movie. The center channel can carry dialogue of a scene in the media content, while the left channel and right channel can carry the ambient noise for the scene (e.g. birds chirping, cars passing, etc.). Further, the left surround channel, the right surround channel, and the low frequency effects channel can carry the music associated with the scene. In some embodiments, converting audio content in a six channel sound format to a binaural audio format takes into account the type of audio content carried on each channel of the audio in the six channel sound format. For example, the mobile device 106 may provide less sound externalization for dialogue audio on the center channel to perceive the dialog close to the user 102, thereby enhancing the listening experience. In other embodiments, music associated with the left surround sound channel, right surround sound channel, and low frequency effects channel may be provided with more sound externalization. Thus, in one or more embodiments, the mobile device 106 detects the audio content type on each audio content channel of the audio content in six channel sound format and determines the amount of sound externalization when rendering the audio content in a binaural audio format.

In or more embodiments, the mobile device detects the audio device for playback of the rendered binaural audio content. In system 100, the audio device is headphones 104. The headphones 104 can be communicatively coupled to the mobile device 106 through either a wireless or wired connection. In other embodiments, the playback audio device can be speakers that are communicatively coupled to the mobile device through a wireless or wired connection. The amount of sound externalization can be dependent on the type of audio device (e.g. wireless headphones, wired headphone, wireless speakers, wired speakers etc.). Each different type of audio content device can have a different frequency response when providing the binaural audio content to the user 102. Thus, the amount of sound externalization can be configured to take into account the frequency response of the playback audio device of the user 102 (e.g. wireless headphones, wired headphone, wireless speakers, wired speakers etc.) to provide an more enhanced listening experience.

In one or more embodiments, the user 102 can configure the amount of sound externalization manually through a user interface and input device (e.g. touchscreen, voice recognition, buttons, gesture, etc.) on mobile device 106. In some embodiments, the mobile device 106 can render or re-render the audio content in a binaural audio format according the user inputted amount or a direction to increase or decrease the amount of sound externalization. In further embodiments, the user 102 can provide a default setting or value for sound externalization through the user interface. In other embodiments, personnel of a media content provider can configure the amount of sound externalization for audio associated with media content for playback on mobile device 106. Such configuring of the sound externalization can be done at the media content server 112 and provided in metadata associated with the audio content for the media content.

In some embodiments, the media content server 112 or some other network device can render the audio content from a six channel sound format to a binaural audio format. The media content server 112 or network device (e.g. head-end device) takes into account the capacity or the audio bit rate of communication network 110 (or some other communication link between the network device and the mobile device 106) and/or the compression ratio in rendering the audio content into the binaural audio format.

In one or more embodiments, the mobile device 106, media content server 112, or the network device can detect one or more network conditions of communication network 110. Further, the mobile device 106, media content server 112, or the network device can provide instructions to adjust the compression ratio for the audio content according to the one or more network condition resulting in an adjusted compression ratio. In some embodiments, the instructions can be provided to a computing device that produces the audio content. In other embodiments, the instructions can be provided to the media content server 112 or network device that relays or transfers the audio content to the mobile device 106 from the computing device that produces the audio content. In addition, the mobile device 106, media content server 112, or the network device can identify the adjusted compression ratio of the audio content. Also, the mobile device 106, media content server 112, or the network device can determine an adjusted sound externalization for rendering the audio content according the adjusted compression ratio of the audio content. Further, the mobile device 106, media content server 112, or the network device can re-render the audio content in a binaural audio format for headphone playback on the audio device according to the adjusted sound externalization. Network conditions can include the capacity of the communication network 110 in terms of either bandwidth or bit rate, latency or delay, noise or distortion, and/or jitter caused by the communication network 110 on data flowing through the communication network 110.

In other embodiments, the media content server 112 can deliver media content with audio content not only to a mobile device 106 but to other devices such as computers (e.g. desktop, laptop, tablet, etc.), set-top box, home theater systems, and other devices that have speakers or headphones with two channel playback capability.

Figure 2:
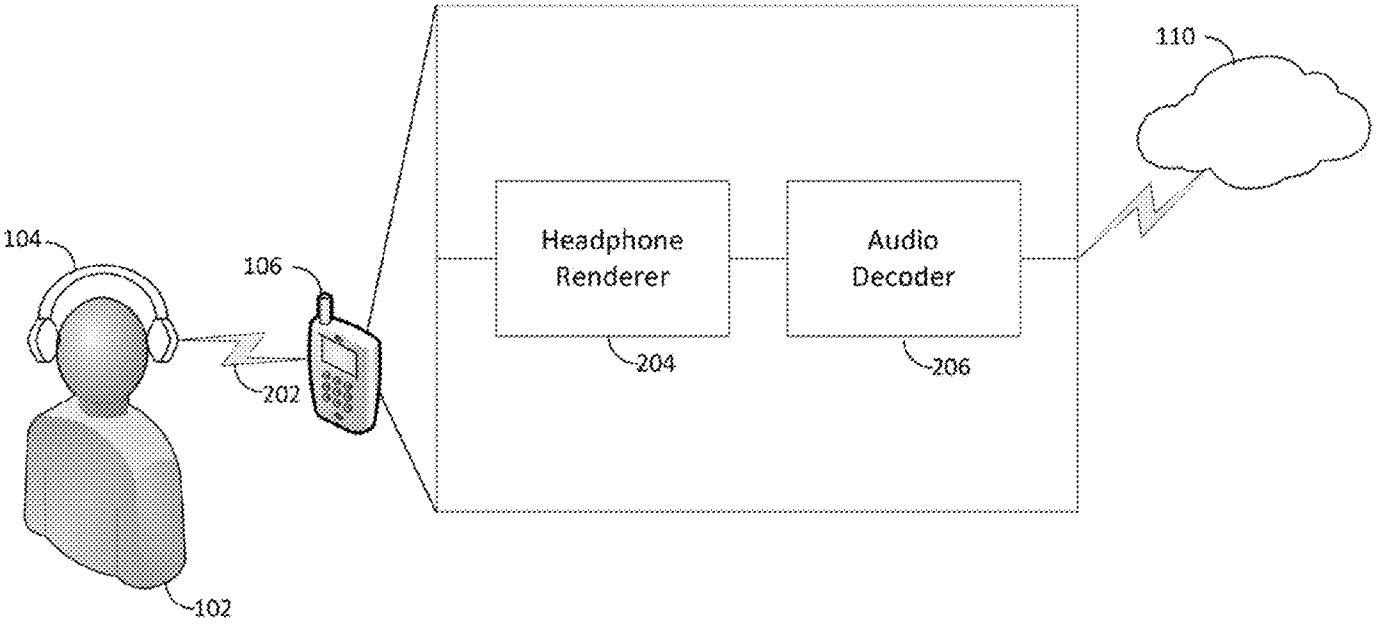

FIG. 2 depicts an illustrative embodiment of a system 200 for rendering binaural audio content. In one or more embodiments, the user 102 can access media content using the mobile device 106 from a media content server 112 across the communication network 110. Further, the mobile device 106 receives audio content in a six channel sound format. However, the user listens to the audio content using headphones 104 having only two channels. Thus, the mobile device 106 converts and renders the audio content from a six channel sound format to a two channel binaural audio format. The mobile device 106 includes an audio decoder 206 to receive and decode the audio content in six channel sound format. The audio decoder 206 can be a combination of software and hardware components of mobile device 106. In some embodiments, the audio decoder 206 can be composed by all or majority of software components. In other embodiments, the audio decoder 206 can be composed by all or majority of hardware components.

In one or more embodiments, the mobile device 106 includes a headphone renderer 204. The headphone renderer 204 converts the audio content into a binaural audio format for headphone playback. Although some embodiments of system 200 may have a headphone renderer, other embodiments may have a renderer that renders binaural audio content for speakers, or any other audio device. A binaural audio format is the result of converting six channel sound format to a two channel binaural audio format. Further, the binaural audio format provides sound externalization, which provides a perception to the user 102 that the sound is generated outside the headphones thereby mimicking surround sound. Sound externalization is provided using digital signal filtering and processing techniques. The renderer takes into account different parameters when determining the sound externalization when rendering the audio content in binaural audio format that include audio bit rate, compression ratio of the received audio content, type of audio content on each channel, type of audio device for playback, or any user input for the amount of sound externalization.

In one or more embodiments, the mobile device 106 detects the audio bit rate. The audio bit rate takes into account the capacity of the communication network to carry audio content. In some embodiments, detecting of the audio bit rate can include the mobile device 106 counting the number of bits received for audio content (or all content) over a time interval to determine the bit rate. In other embodiments, a network device within the communication network or the media content server 112 can provide metadata associated with the media content delivered to the mobile device 106. The metadata can contain the audio bit rate in either in terms of bandwidth or bit rate.

In one or more embodiments, the mobile device 106 can detect or otherwise identify the compression ratio of the audio content delivered to the mobile device 106. Audio content with a large compression ratio can contain distortion. Providing more sound externalization to the audio content with large compression when rendering the binaural audio can mitigate or reduce the distortion. In some embodiments, the compression ratio of the audio content can be in metadata provided with the audio content. In other embodiments, the audio bit rate and compression ratio can be provided to the mobile device 106 as part of management or control data associated with the communication network by a network device or media content server 112. The mobile device 106 can determine an amount of sound externalization to render with the audio content in binaural audio content according to the audio bit rate and/or compression ratio of the audio content.

In one or more embodiments, the six channel sound format for audio content can carry different types of audio on different channels. For example, the media content received from the media content server 112 can be a film with mostly dialogue. Such audio content associated with the media content can have more than one channel carry dialogue while other channels carry ambient noise (e.g. birds chirping, cars passing, etc.) or music for a scene. The mobile device 106 may provide less sound externalization for the dialogue audio on the different channels to enhance the user's listening experience. In other embodiments, and ambient noise and music associated with the other channels may be provided with more sound externalization. Thus, in one or more embodiments, the mobile device detects the audio content type on each audio content channel of the audio content in six channel sound format and determines the amount of sound externalization when rendering the audio content in a binaural audio format.

In one or more embodiments, the mobile device can determine or otherwise detect the average audio bit rate and the average compression ratio. For example, the mobile device can calculate the audio bit rate and the compression ratio for a particular time interval (e.g. several hours, days, etc.). The mobile device 106 can then determine an average audio bit rate and average compression ratio. In some embodiments, the mobile device 106 can be provided or otherwise obtain the average audio bit rate and compression ratio from a network device within communication network, or from a media content server 112. The average audio bit rate and average compression ratio can be provided to the mobile device 106 in metadata associated with the delivered media content. In other embodiments, the average audio bit rate and average compression ratio can be provided to the mobile device 106 as part of management or control data associated with the communication network. In further embodiments, the mobile device 106 can determine a default sound externalization due to the average audio bit rate and/or average compression ratio. In addition, the mobile device 106 can configure an amount of sound externalization when rendering audio content in binaural audio format according to the default sound externalization.

In or more embodiments, the mobile device 106 detects the audio device for playback of the rendered binaural audio. This can include detecting the type of connection 202 between the mobile device 106 and the audio device for playback (e.g. headphones 104). The headphones 104 can be communicatively coupled to the mobile device 106 through either a wireless or wired connection. In other embodiments, the playback audio device can be speakers that are communicatively coupled to the mobile device through a wireless or wired connection. The amount of sound externalization can be dependent on the audio device type (e.g. wireless headphones, wired headphone, wireless speakers, wired speakers etc.). Each audio content device type can have a different frequency response when providing the binaural audio to the user 102. Thus, the amount of sound externalization can be configured to take into account the frequency response of the playback audio device of the user 102 (e.g. wireless headphones, wired headphone, wireless speakers, wired speakers etc.) to provide an enhanced listening experience.

In one or more embodiments, the user 102 can configure the amount of sound externalization manually through a user interface on mobile device 106. Further, the user 102 can provide a default setting or value for sound externalization through the user interface. In some embodiments, personnel of a media content provider can configure the amount of sound externalization for audio associated with media content for playback on mobile device 106. Such configuring of the sound externalization can be done at the media content server 112 and provided in metadata associated with the audio for the media content.

In one or more embodiments, while playing the rendered audio content in binaural audio format, the mobile device 106 can detect a change in the audio bit rate or a change in the compression ratio of the received audio content. Further, the mobile device 106 determine an amount of sound externalization for rendering the audio content in the binaural audio format according to the change in audio bit rate and/or compression ratio. The mobile device 106 can use this updated amount of sound externalization to re-render the audio content in the binaural audio format.

In one or more embodiments, the change in either audio bit rate or compression ratio can be detected by determining that the audio bit rate or compression ratio is above a relative threshold for a time interval when compared to a previously detected, identified, or otherwise determined audio bit rate or compression ratio. For example, a previously detected audio bit rate for audio content can be 64 kilobits per second. A relative threshold can be configured such that the if the audio bit rate increases or decreases by 8 kilobits per second for 1.2 seconds, then a change in the audio bit rate is considered detected. Thus, if the audio bit rate of the audio content decreases to 48 kilobits per second for 2 seconds, then a change in audio bit rate is detected such that an updated amount of sound externalization is determined. Thus, mobile device 106 can dynamically respond to changes in the audio bit rate or compression ratio by re-rendering the binaural audio content according to the updated amount of sound externalization. In other embodiments, a change in the audio bit rat or compression ratio can be provided by the media content server 112 or some other network device.

Figure 3A:
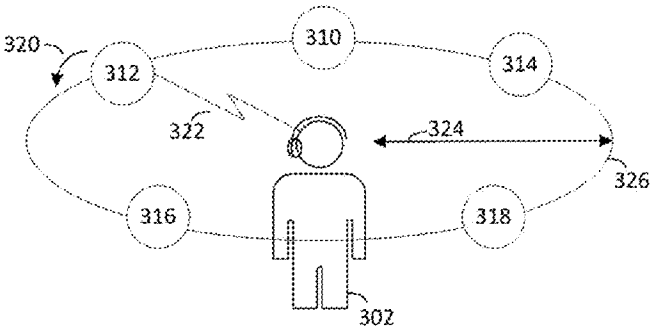

FIG. 3A depicts an illustrative embodiment of a system 300 for rendering binaural audio content. When rendering the binaural audio content from a six channel sound format, sound externalization is used to provide a perception to a user 302 that the sound is provided outside headphones 304 thereby mimicking or simulating surround sound. Sound externalization is provided using digital signal filtering and processing techniques that include filters based on one or more Head Related Transfer Functions (HRTFs) and/or one or more Binaural Room Impulse Response (BRIR) filters. Thus, the sound externalization provides a perception to the user 302 that there are five speakers 310, 312, 314, 316, 318 around the head of the user 302. The BRIR filters provides a perceived position 320 of a speaker 312 while the HRTF filters provides the perceived direction 322 from which the sound is perceived from a speaker 312. Traditionally, media content producers provide predefined HRTF and BRIR filters to render audio content into a binaural audio format. In each predefined set of filters, the perception each speaker 310, 312, 314, 316, 318 is a same radial distance 324 along a circle 326 around the user 302. Each different predefined set of filters can have the speakers 310, 312, 314, 316, 318 at different radial distance from the user 302. Thus, if the audio content that is being rendered is for a movie with a significant amount of dialog, then the one set of predefined filters may be used for rendering allow for sound externalization such that all the perceived speakers have a short radial distance 324. However, if the audio content that is being rendered is for an action movie with a significant amount of surround sound, then another set of the predefined filters that may be used for rendering allow for sound externalization such that all the perceived speakers 310, 312, 314, 316, 318 are at a circle 326 with a long radial distance 324.

HRTFs have been found by persons of ordinary skill in the art based on measurements of audio signals (i.e. head related impulse responses) from speakers to a user in a laboratory environment. The Center for Image Processing and Integrated Computing (CIPIC) has created a database for HRTF functions (see http://interface.cipic.ucdavis.edu/sound/hrtf.html). The database is described in the article V. R. Algazi, R. O. Duda, D. M. Thompson and C. Avendano, "The CIPIC HRTF Database," Proc. 2001 IEEE Workshop on Applications of Signal Processing to Audio and Electroacoustics, pp. 99-102, Mohonk Mountain House, New Paltz, N.Y., Oct. 21-24, 2001 which is incorporated by reference in its entirety herein. Different HRTF filters can be applied to audio content carried by different channels and received in six channel sound format to render the audio content in binaural audio format. Further, BRIR filters can also be applied to different channels of audio content received in six channel sound format to render the audio content in binaural audio format. Examples of BRIR filters can be found in R. Crawford-Emery and H. Lee, "The Subjective Effect of BRIR Length Perceived Headphone Sound Externalisation and Tonal Colouration," Audio Engineering Society, 136$^{th}$ Convention, Paper 9044, pp. 1-9, Berlin, Germany, Apr. 26-29, 2014, which is incorporation by reference in its entirety herein.

In addition, filters that process the audio content of the different channels in six channel sound format can include both HRTFs and BRIR. Such combined HRTF and BRIR filters can be called Combined Head and Room Impulse Response (CHRIR). The transfer functions for CHRIR can be measured in the laboratory and be used as filters in rendering audio content from a multi-channel sound format (e.g. six channel surround sound format) into audio content in a binaural audio format. See article S. Mehrotra, W. Chen, and Z. Zhang, "Interpolation of Combined Head and Room Impulse Response for Audio Spatialization," pp. 1-6, IEEE 13th International Workshop on Multimedia Signal Processing, Hangzhou, China, Oct. 17-19, 2011, which is incorporated by reference in its entirety herein. An example CHRIR transfer function can be expressed as:

$$y_l[n]=\Sigma^{N-1}i=0\Sigma^{L-1}k=0h_{i,l}[k]x_i[n-k] \quad (1)$$

$$y_r[n]=\Sigma^{N-1}i=0\Sigma^{L11}k=0h_{i,r}[k]x_i[n-k] \quad (2)$$

Where $x_i$ is the ith sound source (−0, 1, . . . , N−1), $h_{i,l}$ is the CHRIR of length L (transfer function in time/discrete domain) from the location of source i to the left of the listener, and $h_{i,r}$ be the CHRIR to the right ear. The CHRIR is the combination of the HRTF and RIR and is measured from particular sound locations for a given room. The left and right channels of the output signal are denoted by $y_l$ and $y_r$.

Figure 3B:
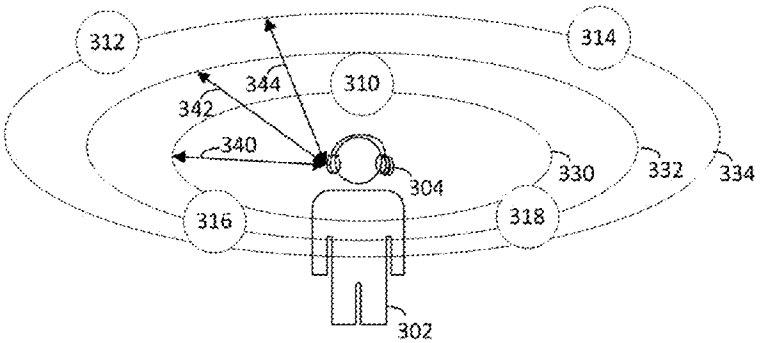

FIG. 3B depicts an illustrative embodiment of a system 301 for rendering binaural audio. The HRTF, BRIR, and/or CHRIR filters used in system 301 allow for sound externalization such that each perceived speaker 310, 312, 314, 316, 318 can be on a circle 330, 332, 334 with a different radial distance 340, 342, 344 from the user 302 listening to the audio content through the headphones 304. The type of filters may depend on the audio bit rate, compression ratio, type of content on each channel, or the type of headphones (or playback audio device). For example, the system 301 renders audio content from a six channel sound format to a binaural audio format. The audio content may be a movie with a car chase. The runaway car can have two people having a dialog with each other. Such a scene can include police cars chasing the runaway car. Also, there may be screaming bystanders running away from the car chase. The center channel of the six channel sound format carries dialog of the two passengers in the runaway car. Based on this type of audio content on the center channel, the filters may process the audio content of the center channel with little or no sound externalization because it would provide a better listening experience if the dialog was perceived to be heard from in front of the user (or even perceived inside the head of the user 302). Thus, the dialog from perceived center speaker 310 can be on the circle 330 with the shortest radial distance 340 from the user. In addition, the left-front channel and right-front channel of the audio content in six channel sound format can carry the sounds of screaming bystanders. Such type of audio content can be filtered with sound externalization such that the screams from the perceived speakers 312, 314 are on the circle 334 at a radial distance 344 that is farther away from the user 302. Further, the left-rear channel and right-rear channel of the audio content in six channel sound format can carry the sounds of police sirens. This type of audio content can be filtered with some sound externalization such that the perceived speakers 316, 318 are at the circle 332 at a radial distance 342 between the farthest circle 334 and the nearest circle 330.

Figure 4:
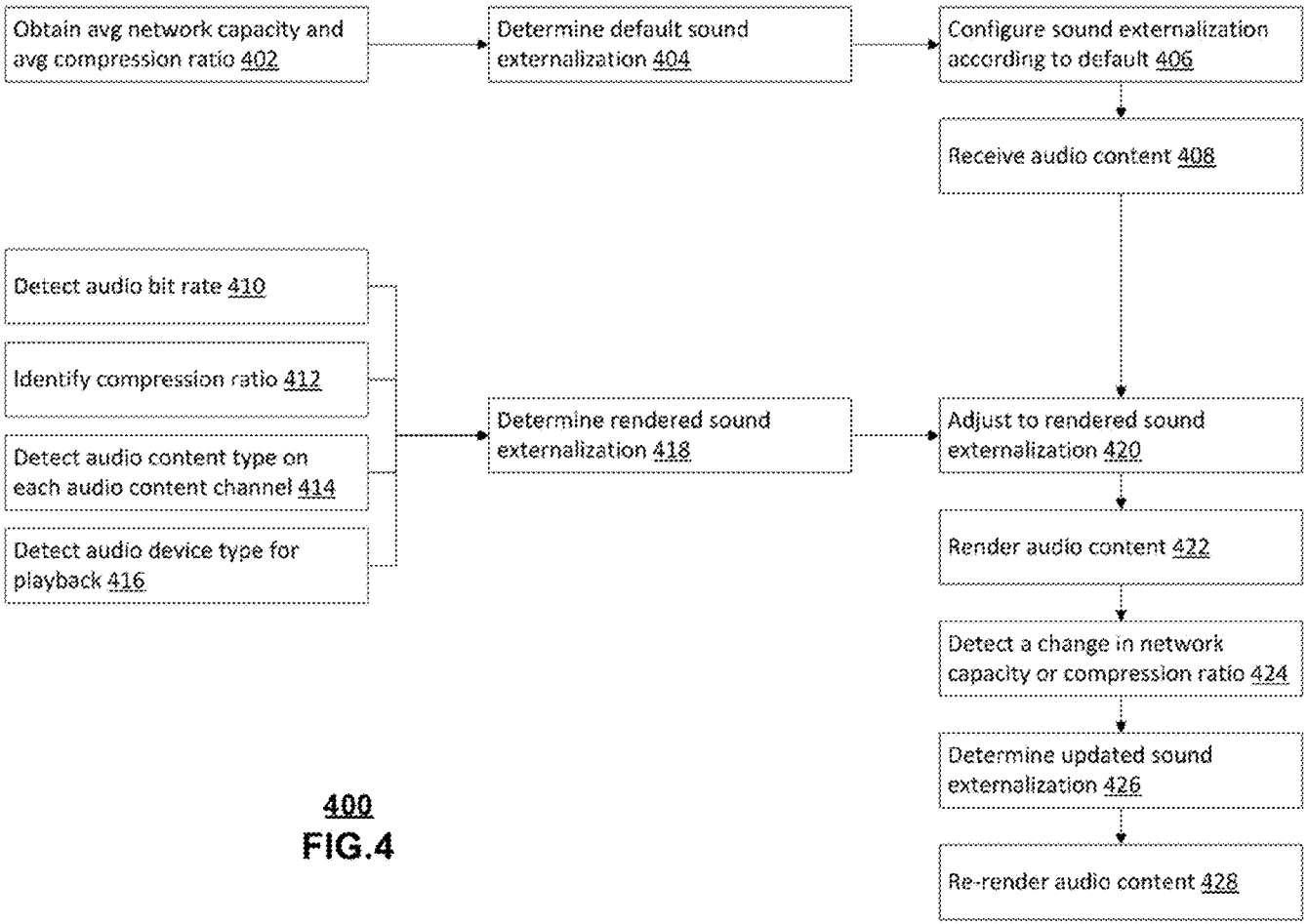
FIG. 4 depicts an illustrative embodiment of a method used in portions of the systems described in FIGS. 1-2 and FIGS. 3A-3B for rendering binaural audio content.

FIG. 4 depicts an illustrative embodiment of a method 400 used by systems 100, 200, 300, and 301 in FIGS. 1-2 and FIGS. 3A-3B for rendering binaural audio content. At a step 402, the method 400 can include the mobile device 106 obtaining an average audio bit rate and/or an average compression ratio for audio content over a time period. Further, at a step 404, the method 400 can include the mobile device 106 determining a default sound externalization according to the average audio bit rate and the average compression ratio for the audio content. In addition, at a step 406, the method 400 can include the mobile device 106 configuring an amount of sound externalization according to the default sound externalization. Also, at a step 408, the method 400 can include receiving audio content in a six channel sound format over the communication network resulting in six channel audio content. The audio content can be associated with media content delivered by the media content server 112. The media content server 112 can be operated by a media content service provider that can include but is not limited to, a cable television service provider, a satellite television service provider, a broadcast television service provider, an Internet service provider, or any other media content service provider.

At a step 410, the method 400 can include mobile device 106 detecting the audio bit rate, and, step 412, the mobile device 106 identifying a compression ratio of the audio content. Audio bit rate is related to compression ratio. Thus, persons of ordinary skill in the art would understand that once an audio bit rate is obtained then the compression ratio can be found with knowledge of the audio compression scheme. Further, once the compression ratio is obtained then the audio bit rate can be found with the knowledge of the audio compression. Therefore, in some embodiments, only one of steps 410 and 412 may be implemented by the method 400. Further, at a step 414, the method 400 can include the mobile device 106 detecting a type of audio content on each channel of the six channel audio content. In addition, at a step 416, the method 400 can include the mobile device 106 detecting a type of audio device used for playback.

At a step 418, the method 400 can include the mobile device 106 determining a rendered sound externalization for rendering the audio content according to any one of the audio bit rate, the compression ratio of the audio content, the audio content type on an audio content channel, audio device type for playback, or a combination thereof.

At a step 420, the method 400 can include the mobile device 106 adjusting the amount of sound externalization to the rendered sound externalization. In some embodiments, this can be adjusting the amount of sound externalization from the default sound externalization to the rendered sound externalization. In other embodiments, the amount of sound externalization is adjusted to the rendered sound externalization after determining any one of the audio bit rate, the compression ratio of the audio content, the audio content type on an audio content channel, audio device type for playback, or a combination thereof. Further, at a step 422, the method 400 can include the mobile device 106 rendering the audio content in a binaural audio format for playback on an audio device according to the rendered sound externalization.

At a step 424, the method 400 can include the mobile device 106 detecting a change in the audio bit rate or a change in the compression ratio of the audio content. Further, at a step 426, the method 400 can include the mobile device 106 determining an updated amount of sound externalization for rendering the audio content according to the change in the audio bit rate and/or the change of the compression ratio of the audio content resulting in updated sound externalization. In addition, the method 400 can include the mobile device 106 re-rendering the audio content in a binaural audio format for playback on the audio device according to the updated sound externalization.

While for purposes of simplicity of explanation, the respective processes are shown and described as a series of blocks in FIG. 4, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methods described herein.

Figure 5:
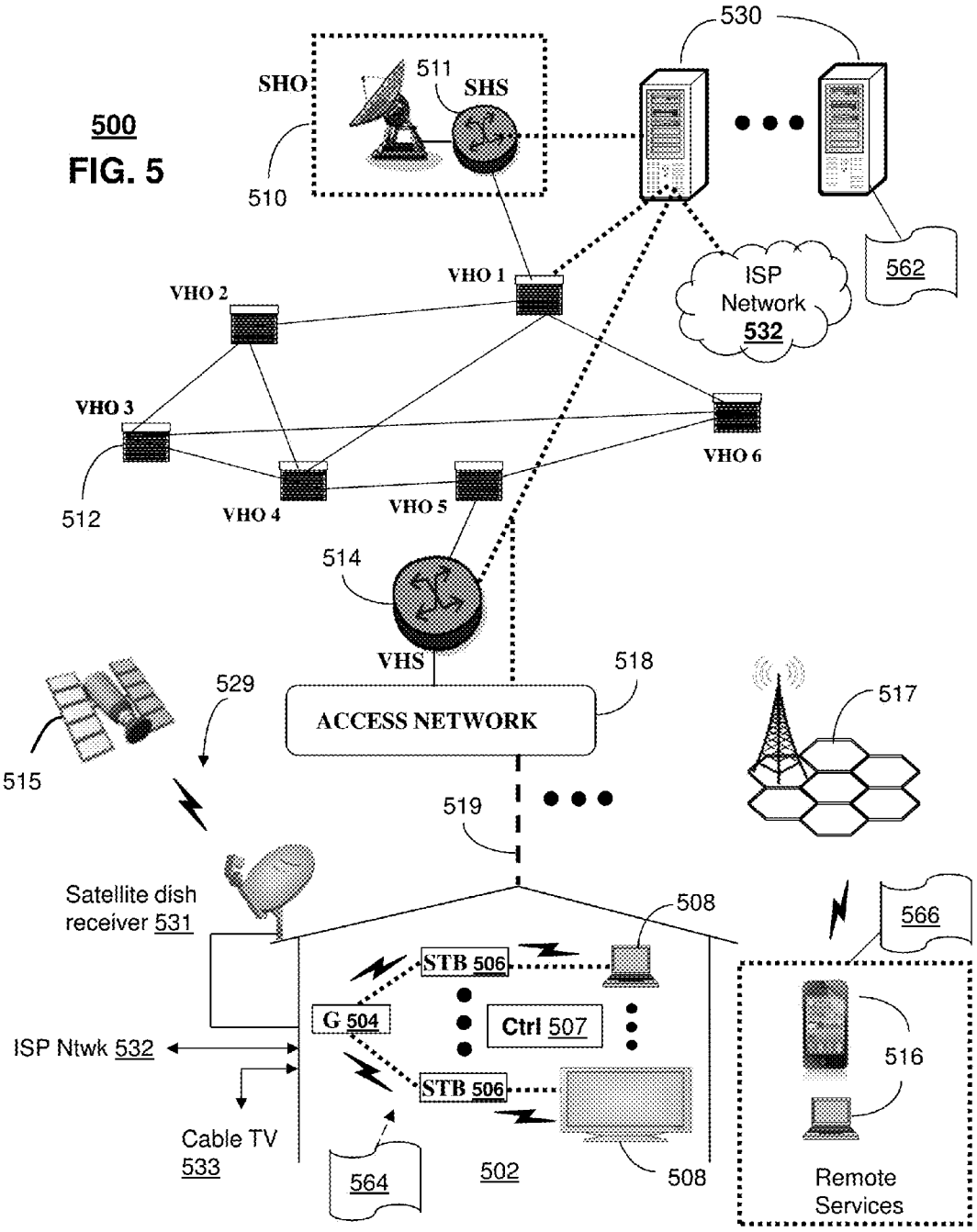
FIG. 5 depict illustrative embodiments of communication systems that provide media services that include rendering binaural audio content.

FIG. 5 depicts an illustrative embodiment of a first communication system 500 for delivering media content including rendering binaural audio content. The communication system 500 can represent an Internet Protocol Television (IPTV) media system. Communication system 500 can be overlaid or operably coupled with to systems 100 and 200 of FIGS. 1 and 2 and systems 300 and 301 of FIGS. 3A and 3B as another representative embodiment of communication system 500. For instance, one or more devices illustrated in the communication system 500 of FIG. 5 such as media presentation devices 508 or remote devices 516 can receive audio content in a multi-channel sound format over a communication network resulting in multi-channel audio content. Further, such media presentation devices 508 or remote devices 516 can include detecting an audio bit rate and/or identifying a compression ratio of the audio content. In addition, media presentation devices 508 or remote devices 516 can include determining a rendered sound externalization for rendering the audio content according to the audio bit rate and/or the compression ratio of the audio content. Also, media presentation devices 508 or remote devices 516 can include rendering the audio content in a binaural audio format for playback on an audio device according to the rendered sound externalization.

The IPTV media system can include a super head-end office (SHO) 510 with at least one super headend office server (SHS) 511 which receives media content from satellite and/or terrestrial communication systems. In the present context, media content can represent, for example, audio content, moving image content such as 2D or 3D videos, video games, virtual reality content, still image content, and combinations thereof. The SHS server 511 can forward packets associated with the media content to one or more video head-end servers (VHS) 514 via a network of video head-end offices (VHO) 512 according to a multicast communication protocol.

The VHS 514 can distribute multimedia broadcast content via an access network 518 to commercial and/or residential buildings 502 housing a gateway 504 (such as a residential or commercial gateway). The access network 518 can represent a group of digital subscriber line access multiplexers (DSLAMs) located in a central office or a service area interface that provide broadband services over fiber optical links or copper twisted pairs 519 to buildings 502. The gateway 504 can use communication technology to distribute broadcast signals to media processors 506 such as Set-Top Boxes (STBs) which in turn present broadcast channels to media devices 508 such as computers or television sets managed in some instances by a media controller 507 (such as an infrared or RF remote controller).

The gateway 504, the media processors 506, and media devices 508 can utilize tethered communication technologies (such as coaxial, powerline or phone line wiring) or can operate over a wireless access protocol such as Wireless Fidelity (WiFi), Bluetooth®, Zigbee®, or other present or next generation local or personal area wireless network technologies. By way of these interfaces, unicast communications can also be invoked between the media processors 506 and subsystems of the IPTV media system for services such as video-on-demand (VoD), browsing an electronic programming guide (EPG), or other infrastructure services.

A satellite broadcast television system 529 can be used in the media system of FIG. 5. The satellite broadcast television system can be overlaid, operably coupled with, or replace the IPTV system as another representative embodiment of communication system 500. In this embodiment, signals transmitted by a satellite 515 that include media content can be received by a satellite dish receiver 531 coupled to the building 502. Modulated signals received by the satellite dish receiver 531 can be transferred to the media processors 506 for demodulating, decoding, encoding, and/or distributing broadcast channels to the media devices 508. The media processors 506 can be equipped with a broadband port to an Internet Service Provider (ISP) network 532 to enable interactive services such as VoD and EPG as described above.

In yet another embodiment, an analog or digital cable broadcast distribution system such as cable TV system 533 can be overlaid, operably coupled with, or replace the IPTV system and/or the satellite TV system as another representative embodiment of communication system 500. In this embodiment, the cable TV system 533 can also provide Internet, telephony, and interactive media services. System 500 enables various types of interactive television and/or services including IPTV, cable and/or satellite.

The subject disclosure can apply to other present or next generation over-the-air and/or landline media content services system.

Some of the network elements of the IPTV media system can be coupled to one or more computing devices 530, a portion of which can operate as a web server for providing web portal services over the ISP network 532 to wireline media devices 508 or wireless communication devices 516.

Communication system 500 can also provide for all or a portion of the computing devices 530 to function as a media content server. The media content server 530 can use computing and communication technology to perform function 562, which can include among other things, can provide an average audio bit rate, average compression ratio compression ratio of audio content, or a default sound externalization for rendering binaural audio as described by systems 100 and 200 of FIGS. 1-2, systems 300 and 301 of FIGS. 3A-3B, and method 400 of FIG. 4. The media processors 506, media presentation devices 508, and wireless communication devices 516 can be provisioned with software functions 564 and 566, respectively, to utilize the services of media content server 530. For instance, functions 564 and 566 of media processors 506 and wireless communication devices 516 can be similar to the functions described for the mobile device 106 of FIGS. 1-2 in accordance with method 400.

Multiple forms of media services can be offered to media devices over landline technologies such as those described above. Additionally, media services can be offered to media devices by way of a wireless access base station 517 operating according to common wireless access protocols such as Global System for Mobile or GSM, Code Division Multiple Access or CDMA, Time Division Multiple Access or TDMA, Universal Mobile Telecommunications or UMTS, World interoperability for Microwave or WiMAX, Software Defined Radio or SDR, Long Term Evolution or LTE, and so on. Other present and next generation wide area wireless access network technologies can be used in one or more embodiments of the subject disclosure.

Figure 6:
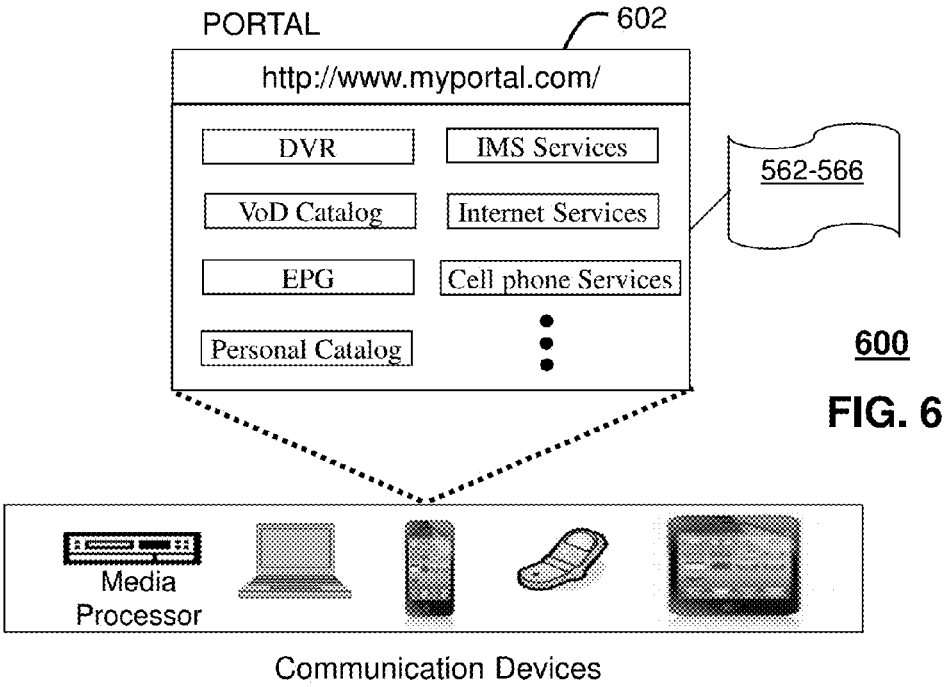
FIG. 6 depicts an illustrative embodiment of a web portal for interacting with the communication systems of FIGS. 1-2, FIGS. 3A-3B, and FIG. 5 for provisioning the rendering of binaural audio content.

FIG. 6 depicts an illustrative embodiment of a web portal 602 of a communication system 600. Communication system 600 can be overlaid or operably coupled with systems 100 and 200 of FIGS. 1 and 2, and/or communication system 500, as another representative embodiment of systems 100 and 200 of FIGS. 1 and 2, and/or communication system 500. The web portal 602 can be used for managing services of systems 100 and 200 of FIGS. 1 and 2 and communication system 500. A web page of the web portal 602 can be accessed by a Uniform Resource Locator (URL) with an Internet browser using an Internet-capable communication device such as the mobile device 106 described in FIGS. 1 and 2 and communication devices 508, 516, of FIG. 5. The web portal 602 can be configured, for example, to access a media processor 506 and services managed thereby such as a Digital Video Recorder (DVR), a Video on Demand (VoD) catalog, an Electronic Programming Guide (EPG), or a personal catalog (such as personal videos, pictures, audio recordings, etc.) stored at the media processor 506. The web portal 602 can also be used for provisioning IMS services described earlier, provisioning Internet services, provisioning cellular phone services, and so on.

The web portal 602 can further be utilized to manage and provision software applications 562-566 to adapt these applications as may be desired by subscribers and/or service providers of systems 100 of FIGS. 1 and 2, and communication system 500. For instance, users of the media content services provided by server 112 or server 530 can log into their on-line accounts and provision the communication device 106, 508, 516, and so on. Service providers can log onto an administrator account to provision, monitor and/or maintain the systems 100 and 200 of FIGS. 1 and 2 or server 530. This can include providing an average audio bit rate, average compression ratio of the audio content over a time period (or the time period itself) as well as providing a default sound externalization for rendering binaural audio and to manually configure the sound externalization in real-time to re-render the binaural audio content, accordingly. The average, change, default, or manually inputted audio bit rate or compression ratio can then be delivered to the mobile device 106 or network device that is rendering the audio content form a multi-channel sound format to a binaural audio format.

Figure 7:
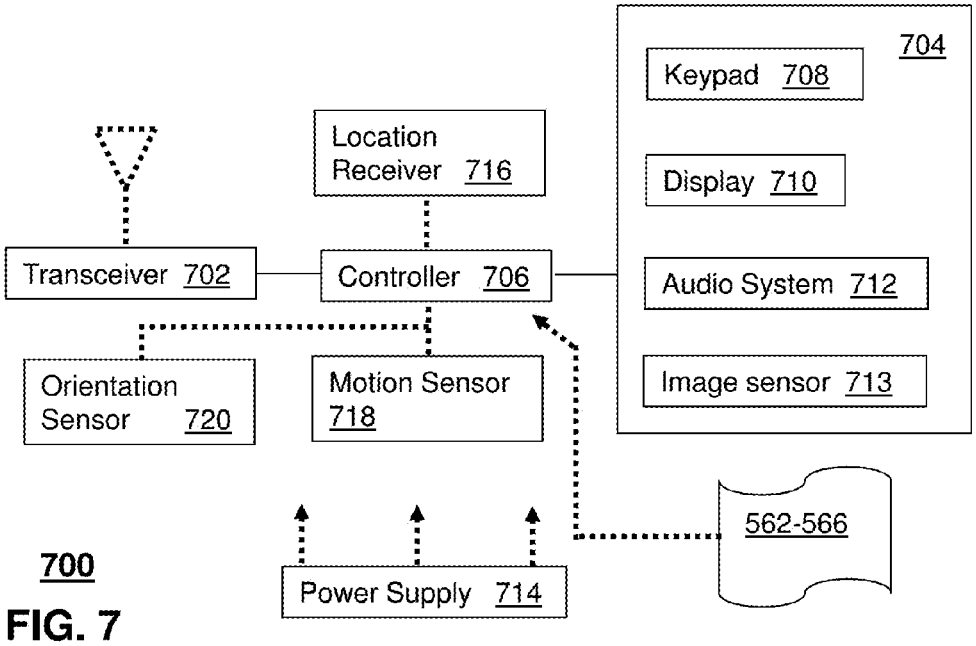
FIG. 7 depicts an illustrative embodiment of a communication device.

FIG. 7 depicts an illustrative embodiment of a communication device 700. Communication device 700 can serve in whole or in part as an illustrative embodiment of the devices depicted in FIGS. 1 and 2, and FIG. 5 and can be configured to perform portions of method 400 of FIG. 4.

Communication device 700 can comprise a wireline and/or wireless transceiver 702 (herein transceiver 702), a user interface (UI) 704, a power supply 714, a location receiver 716, a motion sensor 718, an orientation sensor 720, and a controller 706 for managing operations thereof. The transceiver 702 can support short-range or long-range wireless access technologies such as Bluetooth®, ZigBee®, WiFi, DECT, or cellular communication technologies, just to mention a few (Bluetooth® and ZigBee® are trademarks registered by the Bluetooth® Special Interest Group and the ZigBee® Alliance, respectively). Cellular technologies can include, for example, CDMA-1X, UMTS/HSDPA, GSM/GPRS, TDMA/EDGE, EV/DO, WiMAX, SDR, LTE, as well as other next generation wireless communication technologies as they arise. The transceiver 702 can also be adapted to support circuit-switched wireline access technologies (such as PSTN), packet-switched wireline access technologies (such as TCP/IP, VoIP, etc.), and combinations thereof.

The UI 704 can include a depressible or touch-sensitive keypad 708 with a navigation mechanism such as a roller ball, a joystick, a mouse, or a navigation disk for manipulating operations of the communication device 700. The keypad 708 can be an integral part of a housing assembly of the communication device 700 or an independent device operably coupled thereto by a tethered wireline interface (such as a USB cable) or a wireless interface supporting for example Bluetooth®. The keypad 708 can represent a numeric keypad commonly used by phones, and/or a QWERTY keypad with alphanumeric keys. The UI 704 can further include a display 710 such as monochrome or color LCD (Liquid Crystal Display), OLED (Organic Light Emitting Diode) or other suitable display technology for conveying images to an end user of the communication device 700. In an embodiment where the display 710 is touch-sensitive, a portion or all of the keypad 708 can be presented by way of the display 710 with navigation features.

The display 710 can use touch screen technology to also serve as a user interface for detecting user input. As a touch screen display, the communication device 700 can be adapted to present a user interface with graphical user interface (GUI) elements that can be selected by a user with a touch of a finger. The touch screen display 710 can be equipped with capacitive, resistive or other forms of sensing technology to detect how much surface area of a user's finger has been placed on a portion of the touch screen display. This sensing information can be used to control the manipulation of the GUI elements or other functions of the user interface. The display 710 can be an integral part of the housing assembly of the communication device 700 or an independent device communicatively coupled thereto by a tethered wireline interface (such as a cable) or a wireless interface.

The UI 704 can also include an audio system 712 that utilizes audio technology for conveying low volume audio (such as audio heard in proximity of a human ear) and high volume audio (such as speakerphone for hands free operation). The audio system 712 can further include a microphone for receiving audible signals of an end user. The audio system 712 can also be used for voice recognition applications. The UI 704 can further include an image sensor 713 such as a charged coupled device (CCD) camera for capturing still or moving images.

The power supply 714 can utilize common power management technologies such as replaceable and rechargeable batteries, supply regulation technologies, and/or charging system technologies for supplying energy to the components of the communication device 700 to facilitate long-range or short-range portable applications. Alternatively, or in combination, the charging system can utilize external power sources such as DC power supplied over a physical interface such as a USB port or other suitable tethering technologies.

The location receiver 716 can utilize location technology such as a global positioning system (GPS) receiver capable of assisted GPS for identifying a location of the communication device 700 based on signals generated by a constellation of GPS satellites, which can be used for facilitating location services such as navigation. The motion sensor 718 can utilize motion sensing technology such as an accelerometer, a gyroscope, or other suitable motion sensing technology to detect motion of the communication device 700 in three-dimensional space. The orientation sensor 720 can utilize orientation sensing technology such as a magnetometer to detect the orientation of the communication device 700 (north, south, west, and east, as well as combined orientations in degrees, minutes, or other suitable orientation metrics).

The communication device 700 can use the transceiver 702 to also determine a proximity to a cellular, WiFi, Bluetooth®, or other wireless access points by sensing techniques such as utilizing a received signal strength indicator (RSSI) and/or signal time of arrival (TOA) or time of flight (TOF) measurements. The controller 706 can utilize computing technologies such as a microprocessor, a digital signal processor (DSP), programmable gate arrays, application specific integrated circuits, and/or a video processor with associated storage memory such as Flash, ROM, RAM, SRAM, DRAM or other storage technologies for executing computer instructions, controlling, and processing data supplied by the aforementioned components of the communication device 700.

Other components not shown in FIG. 7 can be used in one or more embodiments of the subject disclosure. For instance, the communication device 700 can include a reset button (not shown). The reset button can be used to reset the controller 706 of the communication device 700. In yet another embodiment, the communication device 700 can also include a factory default setting button positioned, for example, below a small hole in a housing assembly of the communication device 700 to force the communication device 700 to re-establish factory settings. In this embodiment, a user can use a protruding object such as a pen or paper clip tip to reach into the hole and depress the default setting button. The communication device 700 can also include a slot for adding or removing an identity module such as a Subscriber Identity Module (SIM) card. SIM cards can be used for identifying subscriber services, executing programs, storing subscriber data, and so forth.

The communication device 700 as described herein can operate with more or less of the circuit components shown in FIG. 7. These variant embodiments can be used in one or more embodiments of the subject disclosure.

The communication device 700 can be adapted to perform the functions of mobile devices 106 and media content server 112 of FIGS. 1 and/or 2, the media processor 506, the media devices 508, or the portable communication devices 516 of FIG. 5. It will be appreciated that the communication device 600 can also represent other devices that can operate in systems 100 and 200 of FIGS. 1 and/or 2, communication system 500 of FIG. 5 such as a gaming console and a media player. In addition, the controller 706 can be adapted in various embodiments to perform the functions 562-566.

Upon reviewing the aforementioned embodiments, it would be evident to an artisan with ordinary skill in the art that said embodiments can be modified, reduced, or enhanced without departing from the scope of the claims described below. For example, all or portions of some embodiments can be combined with all or portions of other embodiments. Other embodiments can be used in the subject disclosure.

It should be understood that devices described in the exemplary embodiments can be in communication with each other via various wireless and/or wired methodologies. The methodologies can be links that are described as coupled, connected and so forth, which can include unidirectional and/or bidirectional communication over wireless paths and/or wired paths that utilize one or more of various protocols or methodologies, where the coupling and/or connection can be direct (e.g., no intervening processing device) and/or indirect (e.g., an intermediary processing device such as a router).

Figure 8:
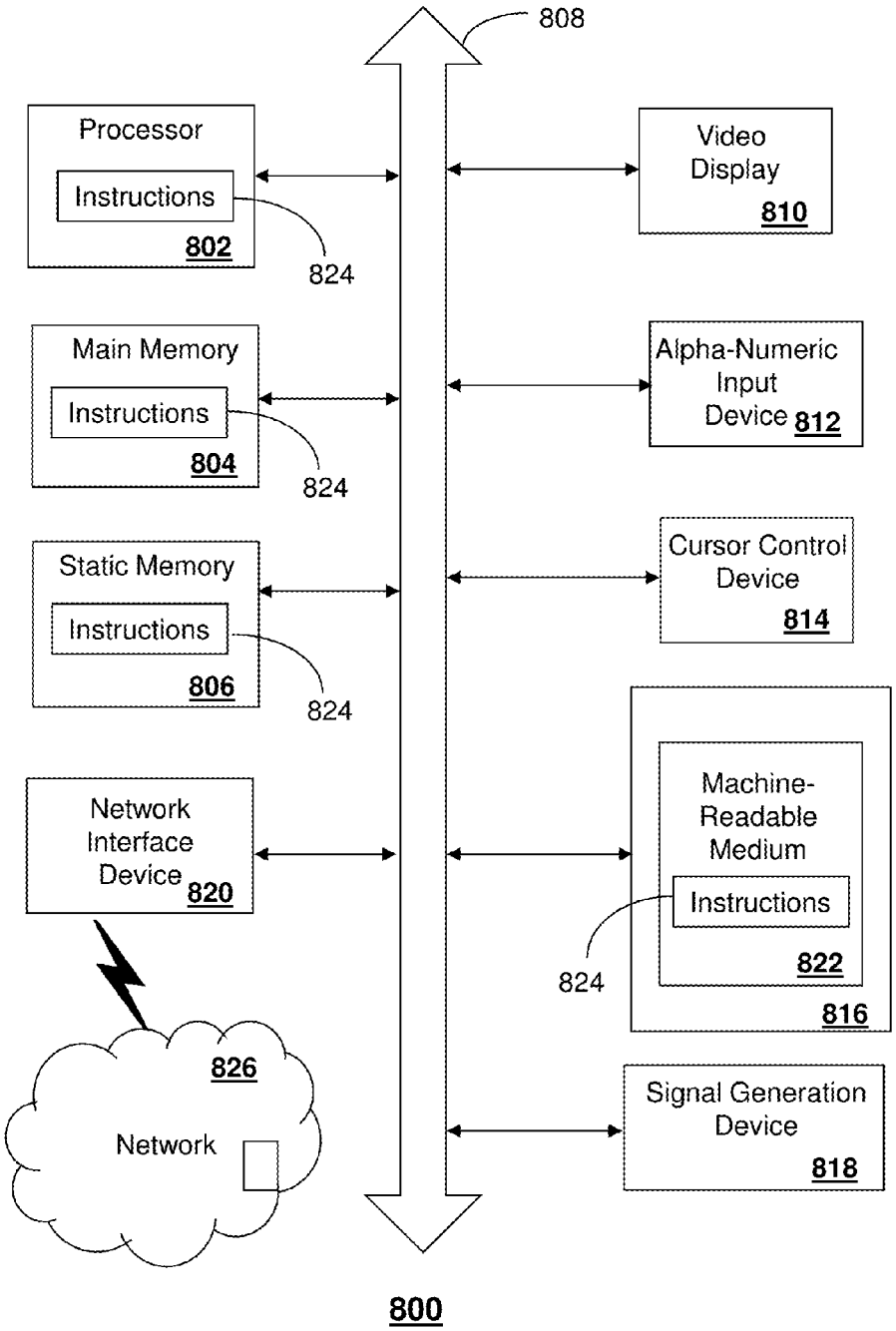
FIG. 8 is a diagrammatic representation of a machine in the form of a computer system within which a set of instructions, when executed, may cause the machine to perform any one or more of the methods described herein.

FIG. 8 depicts an exemplary diagrammatic representation of a machine in the form of a computer system 800 within which a set of instructions, when executed, may cause the machine to perform any one or more of the methods described above. The mobile device 106 can receive audio content associated with the media content provided by the media content server. Further, the mobile device 106 can render the audio content from a multi-channel (e.g. six channel) sound format to a binaural audio format.

In some embodiments, the machine may be connected (e.g., using a network 826) to other machines. In a networked deployment, the machine may operate in the capacity of a server or a client user machine in a server-client user network environment, or as a peer machine in a peer-to-peer (or distributed) network environment.

The machine may comprise a server computer, a client user computer, a personal computer (PC), a tablet, a smart phone, a laptop computer, a desktop computer, a control system, a network router, switch or bridge, or any machine capable of executing a set of instructions (sequential or otherwise) that specify actions to be taken by that machine. It will be understood that a communication device of the subject disclosure includes broadly any electronic device that provides voice, video or data communication. Further, while a single machine is illustrated, the term "machine" shall also be taken to include any collection of machines that individually or jointly execute a set (or multiple sets) of instructions to perform any one or more of the methods discussed herein.

The computer system 800 may include a processor (or controller) 802 (e.g., a central processing unit (CPU)), a graphics processing unit (GPU, or both), a main memory 804 and a static memory 806, which communicate with each other via a bus 808. The computer system 800 may further include a display unit 810 (e.g., a liquid crystal display (LCD), a flat panel, or a solid state display). The computer system 800 may include an input device 812 (e.g., a keyboard), a cursor control device 814 (e.g., a mouse), a disk drive unit 816, a signal generation device 818 (e.g., a speaker or remote control) and a network interface device 820. In distributed environments, the embodiments described in the subject disclosure can be adapted to utilize multiple display units 810 controlled by two or more computer systems 800. In this configuration, presentations described by the subject disclosure may in part be shown in a first of the display units 810, while the remaining portion is presented in a second of the display units 810.

The disk drive unit 816 may include a tangible computer-readable storage medium 822 on which is stored one or more sets of instructions (e.g., software 824) embodying any one or more of the methods or functions described herein, including those methods illustrated above. The instructions 824 may also reside, completely or at least partially, within the main memory 804, the static memory 806, and/or within the processor 802 during execution thereof by the computer system 800. The main memory 804 and the processor 802 also may constitute tangible computer-readable storage media.

Dedicated hardware implementations including, but not limited to, application specific integrated circuits, programmable logic arrays and other hardware devices can likewise be constructed to implement the methods described herein. Application specific integrated circuits and programmable logic array can use downloadable instructions for executing state machines and/or circuit configurations to implement embodiments of the subject disclosure. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the subject disclosure, the operations or methods described herein are intended for operation as software programs or instructions running on or executed by a computer processor or other computing device, and which may include other forms of instructions manifested as a state machine implemented with logic components in an application specific integrated circuit or field programmable gate array. Furthermore, software implementations (e.g., software programs, instructions, etc.) including, but not limited to, distributed processing or component/object distributed processing, parallel processing, or virtual machine processing can also be constructed to implement the methods described herein. Distributed processing environments can include multiple processors in a single machine, single processors in multiple machines, and/or multiple processors in multiple machines. It is further noted that a computing device such as a processor, a controller, a state machine or other suitable device for executing instructions to perform operations or methods may perform such operations directly or indirectly by way of one or more intermediate devices directed by the computing device.

While the tangible computer-readable storage medium 822 is shown in an example embodiment to be a single medium, the term "tangible computer-readable storage medium" should be taken to include a single medium or multiple media (e.g., a centralized or distributed database, and/or associated caches and servers) that store the one or more sets of instructions. The term "tangible computer-readable storage medium" shall also be taken to include any non-transitory medium that is capable of storing or encoding a set of instructions for execution by the machine and that cause the machine to perform any one or more of the methods of the subject disclosure. The term "non-transitory" as in a non-transitory computer-readable storage includes without limitation memories, drives, devices and anything tangible but not a signal per se.

The term "tangible computer-readable storage medium" shall accordingly be taken to include, but not be limited to: solid-state memories such as a memory card or other package that houses one or more read-only (non-volatile) memories, random access memories, or other re-writable (volatile) memories, a magneto-optical or optical medium such as a disk or tape, or other tangible media which can be used to store information. Accordingly, the disclosure is considered to include any one or more of a tangible computer-readable storage medium, as listed herein and including art-recognized equivalents and successor media, in which the software implementations herein are stored.

Although the present specification describes components and functions implemented in the embodiments with reference to particular standards and protocols, the disclosure is not limited to such standards and protocols. Each of the standards for Internet and other packet switched network transmission (e.g., TCP/IP, UDP/IP, HTML, HTTP) represent examples of the state of the art. Such standards are from time-to-time superseded by faster or more efficient equivalents having essentially the same functions. Wireless standards for device detection (e.g., RFID), short-range communications (e.g., Bluetooth®, WiFi, Zigbee®), and long-range communications (e.g., WiMAX, GSM, CDMA, LTE) can be used by computer system 800. In one or more embodiments, information regarding use of services can be generated including services being accessed, media consumption history, user preferences, and so forth. This information can be obtained by various methods including user input, detecting types of communications (e.g., video content vs. audio content), analysis of content streams, and so forth. The generating, obtaining and/or monitoring of this information can be responsive to an authorization provided by the user.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. The exemplary embodiments can include combinations of features and/or steps from multiple embodiments. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Although specific embodiments have been illustrated and described herein, it should be appreciated that any arrangement which achieves the same or similar purpose may be substituted for the embodiments described or shown by the subject disclosure. The subject disclosure is intended to cover any and all adaptations or variations of various embodiments. Combinations of the above embodiments, and other embodiments not specifically described herein, can be used in the subject disclosure. For instance, one or more features from one or more embodiments can be combined with one or more features of one or more other embodiments. In one or more embodiments, features that are positively recited can also be negatively recited and excluded from the embodiment with or without replacement by another structural and/or functional feature. The steps or functions described with respect to the embodiments of the subject disclosure can be performed in any order. The steps or functions described with respect to the embodiments of the subject disclosure can be performed alone or in combination with other steps or functions of the subject disclosure, as well as from other embodiments or from other steps that have not been described in the subject disclosure. Further, more than or less than all of the features described with respect to an embodiment can also be utilized.

Less than all of the steps or functions described with respect to the exemplary processes or methods can also be performed in one or more of the exemplary embodiments. Further, the use of numerical terms to describe a device, component, step or function, such as first, second, third, and so forth, is not intended to describe an order or function unless expressly stated so. The use of the terms first, second, third and so forth, is generally to distinguish between devices, components, steps or functions unless expressly stated otherwise. Additionally, one or more devices or components described with respect to the exemplary embodiments can facilitate one or more functions, where the facilitating (e.g., facilitating access or facilitating establishing a connection) can include less than every step needed to perform the function or can include all of the steps needed to perform the function.

In one or more embodiments, a processor (which can include a controller or circuit) has been described that performs various functions. It should be understood that the processor can be multiple processors, which can include distributed processors or parallel processors in a single machine or multiple machines. The processor can be used in supporting a virtual processing environment. The virtual processing environment may support one or more virtual machines representing computers, servers, or other computing devices. In such virtual machines, components such as microprocessors and storage devices may be virtualized or logically represented. The processor can include a state machine, application specific integrated circuit, and/or programmable gate array including a Field PGA. In one or more embodiments, when a processor executes instructions to perform "operations", this can include the processor performing the operations directly and/or facilitating, directing, or cooperating with another device or component to perform the operations.

The Abstract of the Disclosure is provided with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A device, comprising:

a processing system including a processor; and a memory that stores executable instructions that, when executed by the processing system, facilitate performance of operations, comprising:

receiving audio content in a multi-channel sound format over a communication network resulting in multi-channel audio content;

identifying a compression ratio of the audio content;

determining a rendered sound externalization for rendering the audio content according to the compression ratio of the audio content;

rendering the audio content in a binaural audio format for headphone playback on an audio device according to the rendered sound externalization;

detecting a network condition of the communication network;

providing instructions to adjust the compression ratio for the audio content according to the network condition resulting in an adjusted compression ratio;

identifying the adjusted compression ratio of the audio content;

determining an adjusted sound externalization for rendering the audio content according the adjusted compression ratio of the audio content; and re-rendering the audio content in the binaural audio format for headphone playback on the audio device according to the adjusted sound externalization.

2. The device of claim 1, wherein the operations further comprise detecting a type of audio content on each channel of the multi-channel audio content.

3. The device of claim 2, wherein the determining the rendered sound externalization further comprises determining the rendered sound externalization according to the type of audio content on each channel of the multi-channel audio content.

4. The device of claim 1, wherein the operations further comprise detecting a type of audio device used for headphone playback and wherein the determining the rendered sound externalization further comprises determining the rendered sound externalization according to the type of audio device.

5. The device of claim 1, wherein the operations further comprise:

obtaining an average compression ratio over a time period for the audio content;

determining a default sound externalization according to the average compression ratio over the time period for the audio content; and configuring an amount of sound externalization according to the default sound externalization.

6. The device of claim 5, wherein the rendering of the audio content in the binaural audio format for playback on the audio device according to the rendered sound externalization further comprises adjusting the amount of sound externalization from the default sound externalization to the rendered sound externalization.

7. The device of claim 1, wherein the operations further comprise:

detecting a change in the compression ratio of the audio content;

determining an updated amount of sound externalization for rendering the audio content according to the change of the compression ratio of the audio content resulting in updated sound externalization; and re-rendering the audio content in the binaural audio format for headphone playback on the audio device according to the updated sound externalization.

8. A machine-readable storage medium, comprising executable instructions that, when executed by a processing system including a processor, facilitate performance of operations, comprising:

obtaining an average audio bit rate over a time period for audio content; and determining a default sound externalization according the average audio bit rate for the audio content;

configuring an amount of sound externalization according to the default sound externalization;

receiving the audio content in a multi-channel sound format over a communication network resulting in multi-channel audio content;

detecting a type of audio content on each channel of the multi-channel audio content;

determining a rendered sound externalization for rendering the audio content according the type of audio content on each channel of the multi-channel audio content;

adjusting the amount of sound externalization from the default sound externalization to the rendered sound externalization; and rendering the audio content in a binaural audio format for headphone playback on an audio device according to the rendered sound externalization.

9. The machine-readable storage medium of claim 8, wherein rendering the audio content in the binaural audio format further comprises reducing distortion of the audio content.

10. The machine-readable storage medium of claim 8, wherein the operations further comprise detecting a type of audio device used for headphone playback.

11. The machine-readable storage medium of claim 10, wherein the determining the rendered sound externalization further comprises determining the rendered sound externalization according to the type of audio device.

12. The machine-readable storage medium of claim 8, wherein the rendering of the audio content in the binaural audio format for playback on the audio device according to the rendered sound externalization further comprises adjusting the amount of sound externalization from the default sound externalization to the rendered sound externalization.

13. The machine-readable storage medium of claim 8, wherein the operations further comprise:

detecting a change in audio bit rate of the audio content;

determining an updated amount of sound externalization rendering the audio content according to the change in the audio bit rate of the audio content resulting in updated sound externalization; and re-rendering the audio content in the binaural audio format for headphone playback on the audio device according to the updated sound externalization.

14. The machine-readable storage medium of claim 8, wherein the operations further comprise:

receiving user-generated input; and adjusting the rendered sound externalization according to the user-generated input resulting in adjusted sound externalization; and re-rendering the audio content in the binaural audio format for headphone playback on the audio device according to the adjusted sound externalization.

15. A method, comprising:

obtaining by a processing system comprising a processor an average compression ratio for audio content;

determining, by the processing system, a default sound externalization according to the average compression ratio for the audio content;

configuring, by the processing system, an amount of sound externalization according to the default sound externalization;

receiving, by the processing system, the audio content in a multi-channel sound format over a communication network resulting in multi-channel audio content;

identifying, by the processing system, a compression ratio of the audio content;

determining, by the processing system, a rendered sound externalization for rendering the audio content according to the compression ratio of the audio content;

rendering, by the processing system, the audio content in a binaural audio format for headphone playback on an audio device according to the rendered sound externalization;

detecting, by the processing system, a change in the compression ratio of the audio content;

determining, by the processing system, an updated amount of sound externalization rendering the audio content according to the change of the compression ratio of the audio content resulting in updated sound externalization; and re-rendering the audio content in the binaural audio format for headphone playback on the audio device according to the updated sound externalization.

16. The method of claim 15, wherein re-rendering the audio content in the binaural audio format further comprises reducing distortion of the audio content.

17. The method of claim 15, comprising detecting, by the processing system, a type of audio content on each channel of the multi-channel audio content and wherein the determining the rendered sound externalization further comprises determining, by the processing system, the rendered sound externalization according to the type of audio content on each channel of the multi-channel audio content.

18. The method of claim 15, comprising detecting, by the processing system, a type of audio device used for headphone playback.

19. The method of claim 18, wherein the determining the rendered sound externalization further comprises determining, by the processing system, the rendered sound externalization according to the audio device.

20. The method of claim 19, wherein the rendering of the audio content in the binaural audio format for headphone playback on the audio device according to the rendered sound externalization further comprises adjusting the amount of sound externalization from the default sound externalization to the rendered sound externalization.

* * * * *